US005495072A

United States Patent [19]

Kumagi

[11] Patent Number: 5,495,072

[45] Date of Patent: Feb. 27, 1996

[54] AUTOMATIC PERFORMANCE APPARATUS

[75] Inventor: Tomoyuki Kumagi, Hamamatsu, Japan

[73] Assignee: Yamaha Corporation, Japan

[21] Appl. No.: 467,138

[22] Filed: Jun. 6, 1995

Related U.S. Application Data

[63] Continuation of Ser. No. 770,647, Oct. 3, 1991.

[30] Foreign Application Priority Data

Oct. 9, 1990 [JP] Japan ..... 2-269644

[51] Int. Cl.[6] ..... G10H 1/06

[52] U.S. Cl. ..... 84/601; 84/609; 84/622; 84/645; 84/653; 84/659

[58] Field of Search ..... 84/601–604, 609, 84/610, 614, 649, DIG. 29, 622, 625, 641, 642, 645, 647, 653, 659, 660

[56] References Cited

U.S. PATENT DOCUMENTS

| | | | |
|---|---|---|---|
| 3,781,452 | 12/1973 | Vavclain | 84/DIG. 29 |
| 4,448,104 | 5/1984 | Hoshii . | |
| 4,655,112 | 4/1987 | Mitarai . | |
| 4,899,832 | 2/1990 | Okamura | 84/601 |
| 4,930,390 | 6/1990 | Kellogg et al. | 84/611 |
| 4,945,804 | 8/1990 | Farrand | 84/484 X |
| 4,960,031 | 10/1990 | Farrand | 84/609 |

*Primary Examiner*—Brian Sircus
*Attorney, Agent, or Firm*—Graham & James

[57] ABSTRACT

An automatic performance apparatus comprises a performance data storage track for storing sequential performance data for controlling musical tones to be sequentially generated according to progress of a music piece, a plurality of element data storage tracks for storing sequential data consisting of at least one type of element data such as pitch data, timing data, and the like, constituting performance data, panel switches for designating the element data storage tracks or a type of data to be written in and/or read out from the element data storage tracks, and a CPU for sequentially reading out and synthesizing the element data from the element data storage tracks, and writing the synthesized data in the performance data storage track as new performance data.

13 Claims, 11 Drawing Sheets

| |
|---|
| 1 0 0 t t t t t |

FIG. 3A

| |
|---|
| 1 0 1 t t t t t |
| 0 t t t t t t t |

FIG. 3B

| |
|---|
| 1 1 0 0 d d d d |
| 0 k k k k k k k |
| 0 v v v v v v v |

FIG. 4A

| |
|---|
| 1 1 0 1 d d d d |
| 0 d d d d d d d |
| 0 k k k k k k k |
| 0 v v v v v v v |

FIG. 4B

| MEAS | TEMP | TIME | SONG |
|---|---|---|---|
| 001 | 120 | 4/4 | 1 |

FIG. 5A

| MEAS BEAT CLCK | STEP | EVNT | GATE | VEL | TRCK |
|---|---|---|---|---|---|
| 001 — 1 — 00 | ♩ | C3 | 80% | 64 | 1 |

FIG. 5B

| MEAS | TEMP | TIME | TRCK |
|---|---|---|---|
| 001 | 120 | 4/4 | 1 |

FIG. 5C

| TIME | NOTE | VELT | DEST |
|---|---|---|---|
| TR1 | TR2 | TR3 | TR4 |

FIG. 5D

AUTOMATIC PERFORMANCE APPARATUS

This is a continuation of application Ser. No. 07/770,647 filed Oct. 3, 1991, now abandonded.

BACKGROUND OF THE INVENTION

1. Field of the Invention

The present invention relates to an automatic performance apparatus for making an automatic performance on the basis of performance data stored in a storage means and, more particularly, to an automatic performance apparatus which can facilitate an operation when a user writes performance data in the storage means.

2. Description of the Related Art

As a method of forming performance data in an automatic performance apparatus, i.e., a method of writing performance data in a storage means such as a memory, so-called real time and step input methods are known.

In the real time input method, pitch data, timing data, velocity data, and the like are detected from data obtained by playing a keyboard, and are written in a memory to form performance data. However, the real time input method is not easy for users who cannot play the keyboard instrument, and it is particularly difficult for beginners to execute this method.

In the step input method, pitch data, timing data, velocity data, and the like are inputted as numeric values, thus forming performance data. However, in this step input method, data values must be inputted one by one. Therefore, an input operation requires much time and labor.

SUMMARY OF THE INVENTION

The present invention has been made in consideration of the conventional drawbacks, and has as its object to provide an automatic performance apparatus which can easily form performance data within a short period of time.

In order to achieve tile above object, according to an automatic performance apparatus of the present invention, element data such as pitch data, timing data, velocity data, and the like are separately written in a plurality of storage tracks, and are synthesized later to form one performance data.

Element data storage tracks for writing the element data may be separately arranged from performance data storage tracks for writing performance data, or may be commonly used as the performance data storage tracks. When the element data storage tracks are commonly used as the performance data storage tracks, a designation means is arranged to designate a type of element data to be synthesized and the performance data storage track which stores the corresponding element data upon synthesis of the performance data. When tile element data storage tracks are separately arranged from the performance data storage tracks, tile track or data type can be designated when each element data is written.

According to tile above-mentioned arrangement, element data of performance data can be individually inputted. For example, pitch data can be inputted first, and then, timing data can be inputted. In this case, an input operation of only pitch data can be attained by performing a keyboard performance while concentrating on ON key positions, or may be inputted by a step input method using a keyboard. On the other hand, an input operation of only timing data can be attained by operating, e.g., only one key to have correct timings regardless of keys to be depressed. As another element data, velocity data can be similarly inputted by operating keys while paying attention to only key touches.

This input method is relatively easy for a beginner, and an input time can also be shortened as compared to that required for inputting all the elements of performance data by the step method since a real time input operation is repeated two to three times, and thereafter, a synthesis operation need only be set.

As described above, according to the present invention, a user who cannot play the keyboard instrument well can easily form performance data without requiring a long input time.

BRIEF DESCRIPTION OF THE DRAWINGS

FIGS. 3A and 3B show formats of duration data in the performance data shown in FIG. 2;

FIGS. 4A and 4B show formats of note data in the performance data shown in FIG. 2;

FIGS. 5A to 5D show images to be displayed on a display in the apparatus shown in FIG. 1;

DETAILED DESCRIPTION OF THE PREFERRED EMBODIMENT

An embodiment of the present invention will be described below with reference to the accompanying drawings.

Figure 1:
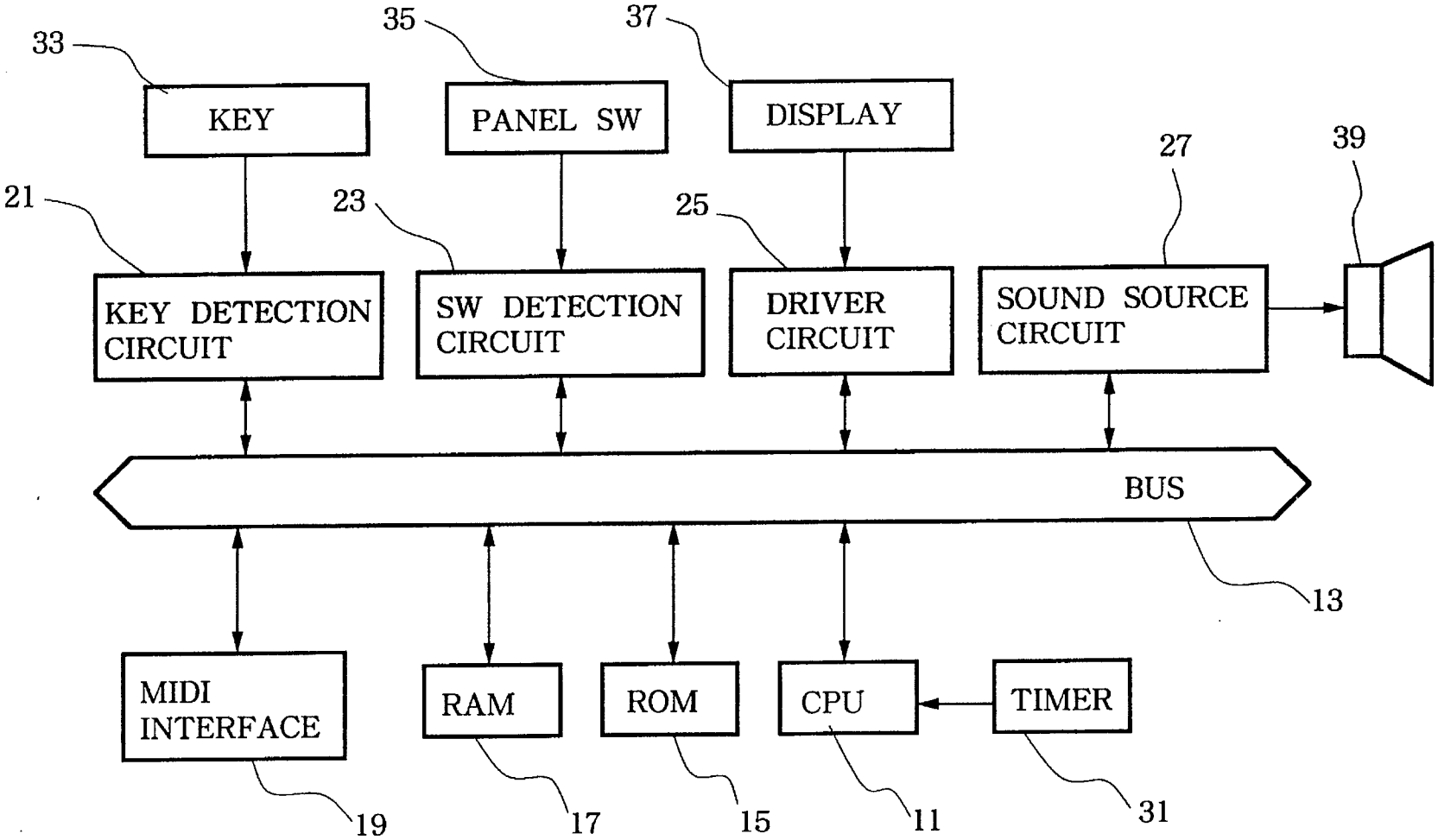
FIG. 1 is a block diagram showing a hardware arrangement of an automatic performance apparatus according to an embodiment of the present invention.

FIG. 1 shows a hardware arrangement of an automatic performance apparatus according to an embodiment of the present invention.

The apparatus shown in FIG. 1 controls the overall operation using a central processing unit (CPU) 11. The CPU 11 is connected to a read-only memory (ROM) 15, a random access memory (RAM) 17, an MIDI interface 19, a key detection circuit 21, a switch detection circuit 23, a driver circuit 25, and a sound source circuit 27 via a bidirectional bus line 13. The CPU 11 is also connected to a timer circuit 31 via a signal line 29. The key detection circuit 21 is connected to a keyboard circuit 33. The switch detection circuit 23 is connected to panel switches 35. The driver circuit 25 is connected to a display 37, and the sound source circuit 27 is connected to a sound system 39.

The ROM 15 stores various control programs of main routine processing, timer interrupt processing, and the like corresponding to the flow charts shown in FIGS. 7 to 12. The ROM 15 also stores automatic performance data set by a manufacturer.

The RAM 17 is set with registers for temporarily storing various data generated upon execution of the control programs by the CPU 11, and eight performance data storage tracks to which a user can write performance data.

Figure 2:
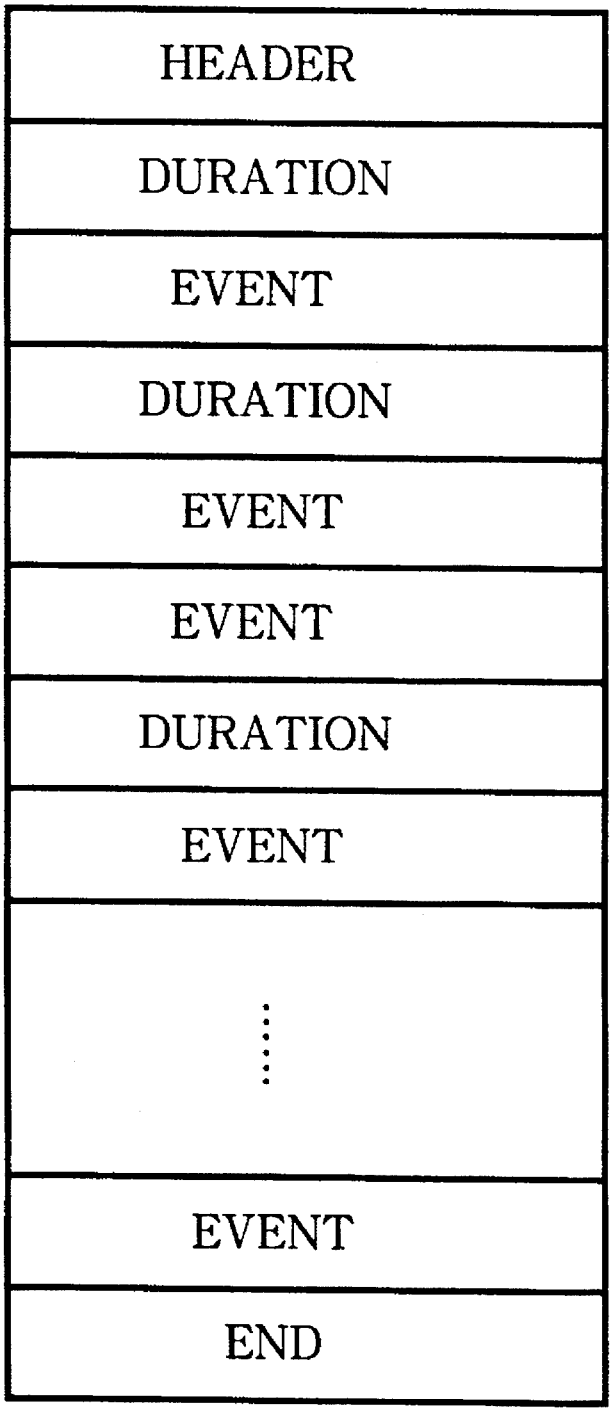
FIG. 2 shows a format of performance data to be recorded in a RAM in the apparatus shown in FIG. 1.

FIG. 2 shows a data architecture of a performance data storage track of the ROM 15 and the RAM 17. Several bytes from the starting address of the performance data storage track correspond to a header area to which tone color data, tempo data, meter data, arid the like are written. An end mark (END) is written at the end address of the track. A performance data main body consisting of duration data (time data between adjacent events) and event data is written between the header area and the end mark.

A duration is represented by the number of tempo clocks each having a period corresponding to 1/24 a quarter note. The duration data has two formats, i.e., short and long formats. The short format is of 8-bit (1-byte) data representing a duration corresponding to a tempo clock count of 1 to 31. In the short format, as shown in FIG. 3A, a code "100" representing the short format is written in upper 3 bits, and a numeric value ttttt of one of 1 to 31 representing a duration is written in lower 5 bits.

When a duration exceeds a clock count of 31, the long format shown in FIG. 3B obtained by adding one post byte to the short format is used. In the post byte, "0" representing the post byte is written in the most significant bit (MSB), and lower 7 bits of duration data are written in lower 7 bits. In this case, upper 5 bits of duration data are written in lower 5 bits of the short format side. More specifically, 12-bit data representing a clock count of one of 1 to 4,095 can be written in the long format. Thus, the longest time of the duration data is about 85 sec when a tempo is=120. In both the short and long formats, clock count data 0 is inhibited from being written.

In FIG. 2, event data or note event data represents an ON/OFF state of a key, and is 3- or 4-byte data consisting of gate time data representing a tone generation sustain time, note number data representing a pitch, and velocity data representing a key touch.

Table 1 below shows examples of duration (time) data, and gate time data.

TABLE 1

| Note | Time | Gate Time |
|---|---|---|
| Whole Note | 96 | 48 |
| Half-note | 48 | 24 |
| Quarter Note | 24 | 12 |
| Eighth Note | 12 | 6 |
| Sixteenth Note | 6 | 3 |

The event data has two formats, i.e., short and long formats shown in FIGS. 4A and 4B in accordance with the gate time. The short format shown in FIG. 4A is of 3-byte data which is used in the case of the gate time corresponds to a clock count of 0 to 15. In the short format, a code "1100" representing short-format note event data is written in upper 4 bits of the first byte, and a numeric value dddd representing a gate time is written in its lower four bits. In the second byte, "0" representing that the corresponding byte is not independent data is written in the MSB, and a note number expressed by a numeric value kkkkkkk of one of 0 to 127 is written in lower 7 bits. The note number kkkkkkk is data representing a pitch C2 as 0, a pitch G8 as 127, and pitches therebetween as numeric values indicating intervals from C2 as the number of semitones. In the third byte of the event data, "0" representing that the corresponding byte is not independent data is written in the MSB, and key-on velocity vvvvvvv as numeric value data of one of 1 to 127 is written in lower 7 bits. Note that the key-on velocity data can be omitted.

When a gate time exceeds a clock count of 15, the long format shown in FIG. 4B obtained by adding one byte between the first and second bytes of the short format is used. In the first byte of the long format, an identification code "1101" representing the long format is written in upper four bits, and a numeric value dddd of one of 0 to 15 representing upper four bits of a gate time is written in lower four bits. In the added one byte, "0" is written in the MSB like in the post byte shown in FIG. 3B, and lower 7 bits of a gate time expressed by a numeric value ddddddd of one of 0 to 127 are written in lower 7 bits. In the long format, numeric value data having a data length of 11 bits, and representing a gate time of one of 0 to 2,047 can be written.

The long format includes the same note number data and key-on velocity data as in the short format, except that they are shifted to the third and fourth bytes since one byte is added.

In this embodiment, a clock of the gate time corresponds to 1/24 a quarter note in the same manner as in the duration data. The upper limit of the gate time is limited to 2,047 ($7FF), and data exceeding the limit are limited. Therefore, the longest gate time is about 42 sec when a tempo is=120.

Some registers, and the like set in the RAM 17 will be exemplified below. In the following description, the registers, and the like, and their contents are represented by the same labels.

COUNT(i): First count register

This register counts a time (gate time) from a key ON event to a key OFF event in correspondence with a channel i to which the ON key is assigned.

COUNT2: Second count register

This register counts a time (duration) from a key ON event to the next key ON event.

DSP: Display register

This register represents a display screen mode, and a processing mode in a song mode.

0: Screen mode of FIG. 5A; Play mode

1: Screen mode of FIG. 5B or 5C; Recording mode

2: Screen data of FIG. 5D; Combine mode

DST: Destination track

This register represents a performance data storage track to which new synthesized performance data is written.

MODE: Mode register

0: Song mode

Pattern mode

2: Utility mode

3: Voice mode

NOTE: Note source track

This register represents a read source track of note data.

STPF: Step recording mode flag

0: Real time recording mode

1: Step recording mode

TIME: Duration source track

This register represents a read source track of duration data.

TC: Tempo clock register

VELT: Velocity source track

This register represents a read source track of velocity data.

In FIG. 1, the MIDI interface 19 exchanges data with other MIDI equipments such as a computer system, an electronic musical instrument, an external keyboard, an external sound source, and the like.

The key detection circuit 21 detects states of respective keys of a keyboard to generate key data representing key ON, key OFF and key touch (initial touch) of the respective keys.

Figure 6:
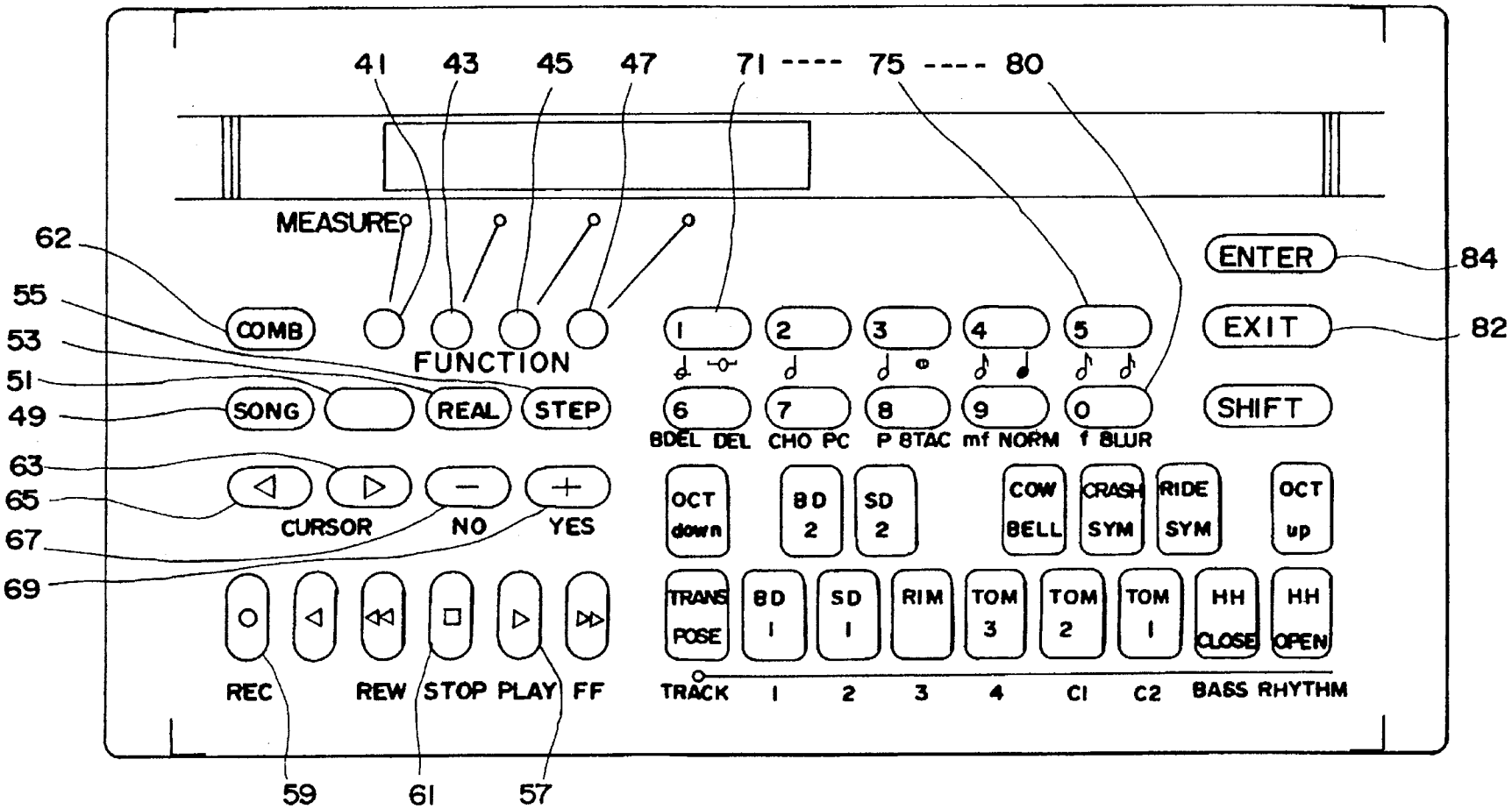
FIG. 6 is a plan view showing the outer appearance of a panel switch of the apparatus shown in FIG. 1.

The switch detection circuit 23 generates switch data representing ON/OFF or setting states of respective switches of the panel switches 35. FIG. 6 shows the outer appearance of the automatic performance apparatus shown in FIG. 1. On the surface of this automatic performance apparatus, the panel switch 35 consisting of a large number of switches is arranged. The panel switches include function keys 41 to 47 for selecting the utility mode and the voice mode, processing mode keys 49 to 55 for selecting song (SONG), pattern (PATTERN), real time (REAL) recording, and step (STEP) recording modes, a play (PLAY) key 57 for instructing the start of an automatic performance, a recording (REC) key 59 which is depressed simultaneously with the play key 57 to instruct a write operation of performance data, a stop (STOP) key 61 for instructing a recording operation, a play operation, and the like, a combine (COMB) key 62 for setting a combine mode for combining data read out from the respective performance mode tracks to synthesize new performance data, cursor keys 63 and 65, a plus (+) key 67, a minus (–) key 69, ten keys 71 to 80, which keys are used to input numeric value data, and the like.

The driver circuit 25 drives the display 37 on the basis of an instruction sent from the CPU 11 based on an operation of the cursor keys 63 and 65, the "+" and "–" keys 67 and 69, the ten keys 71 to 80, and the like. FIGS. 5A to 5D show display examples on the display 37 in the respective operation or processing modes. FIG. 5A shows a display example in the song mode; FIG. 5B, a display example in the step recording mode; FIG. 5C, a display example in the real time recording mode; and FIG. 51D, a display example in the combine mode.

The sound source circuit 27 forms a musical tone signal on the basis of musical tone control data sent from the CPU 11 in accordance with data read out from the performance data recording tracks or operations of the keyboard during a play or recording operation. The musical tone signal is supplied to the sound system 39 including a D/A converter, an amplifier, a loudspeaker, and the like. The sound system 39 converts the musical tone signal into an acoustic wave, and produces it as an actual tone.

The operation of the CPU 11 in the automatic performance apparatus shown in FIG. 1 will be explained below with reference to the flow charts shown in FIGS. 7 to 12.

When a power switch (not shown) of the automatic performance apparatus shown in FIG. 1 is turned on, the CPU 11 starts an operation in accordance with the control program stored in the ROM 15.

Figure 7:
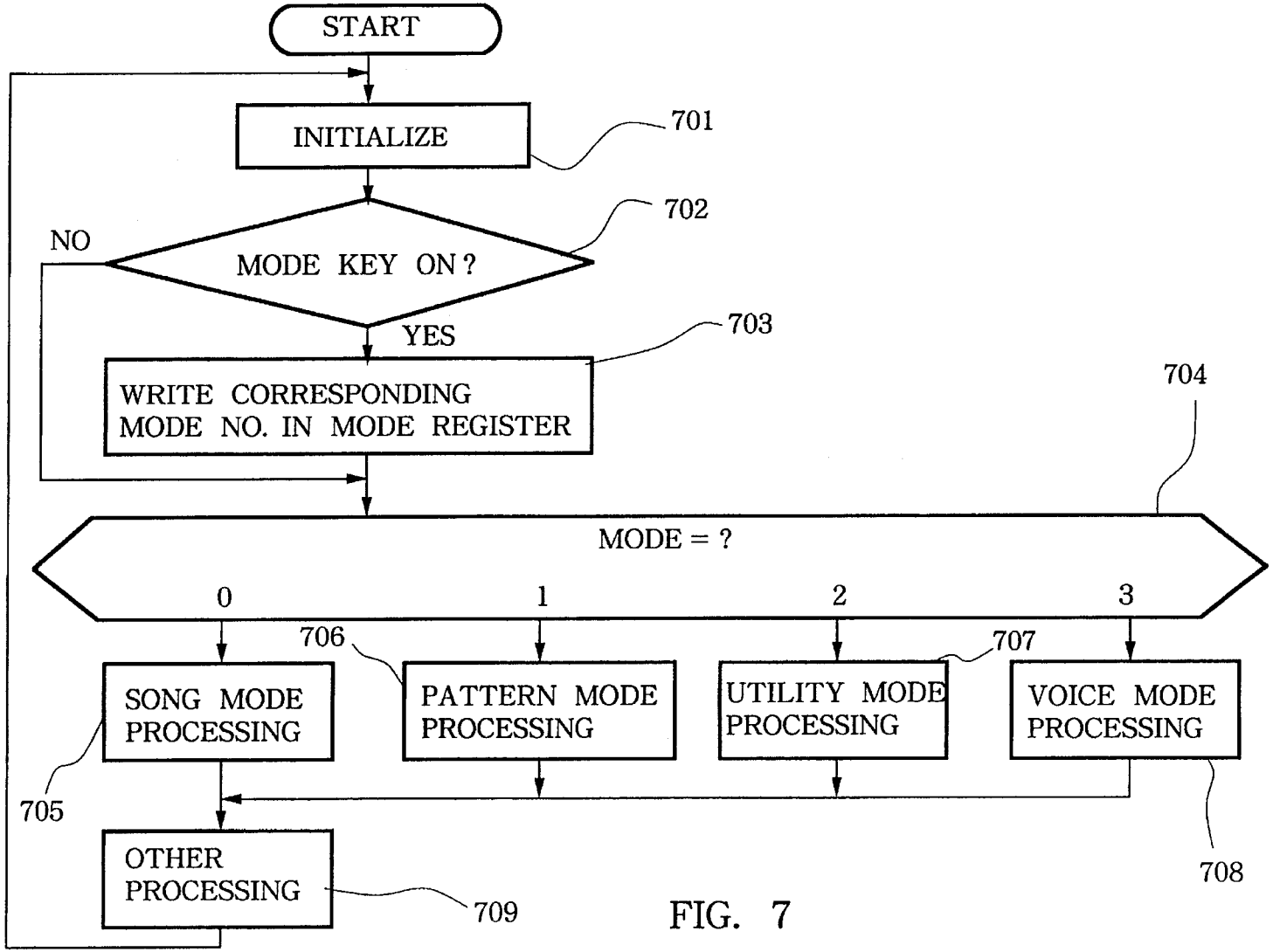
FIGS. 7 to 12 are flow charts showing processing executed by a CPU shown in FIG. 1.

Referring to FIG. 7, the CPU 11 performs initialization, for example, clears the registers and flags allocated in the RAM 17, or sets them to predetermined preset values in step 701. In step 702, the CPU 11 cheeks if one of the function and mode keys 41 to 51 is turned on. If YES in step 702, a mode number corresponding to the ON mode key is written in the mode register MODE in step 703. More specifically, if the song Roy 49 is turned on, the CPU 11 writes "0" representing the song mode in the mode register MODE; if the pattern key 51 is turned on, it writes "1" representing the pattern mode; or if one of the Function keys 41 to 47 is turned on, it writes "2" representing the utility mode or "3" representing the voice mode in accordance with the ON key. Subsequently, the flow advances to step 704. If "NO" in step 702, i.e., if it is determined that none of the mode keys 41 to 51 is turned on, the flow directly jumps from step 702 to step 704 while skipping step 703.

In step 704, the flow branches to a step according to the content of the mode register MODE. More specifically, if the content of the register MODE, i.e., the presently selected operation mode is the song mode (MODE=0), the flow branches to song mode processing (step 705) for creating data throughout a music piece; if it is the pattern mode (MODE=1), the flow branches to pattern mode processing (step 706) for creating data for one to two measures; if it is the utility mode (MODE=2), the flow branches to utility mode processing (step 707) for setting, e.g., MIDI data; or if it is the voice mode (MODE=3), the flow branches to voice mode processing (step 708) for setting the sound source associated data. Upon completion of processing in one of steps 705 to 708, other processing including state detection of other panel keys, setting processing according to the detected state, and the like is executed in step 709. Thereafter, the flow returns to step 702, and the above-mentioned processing is repeated.

Figure 8:
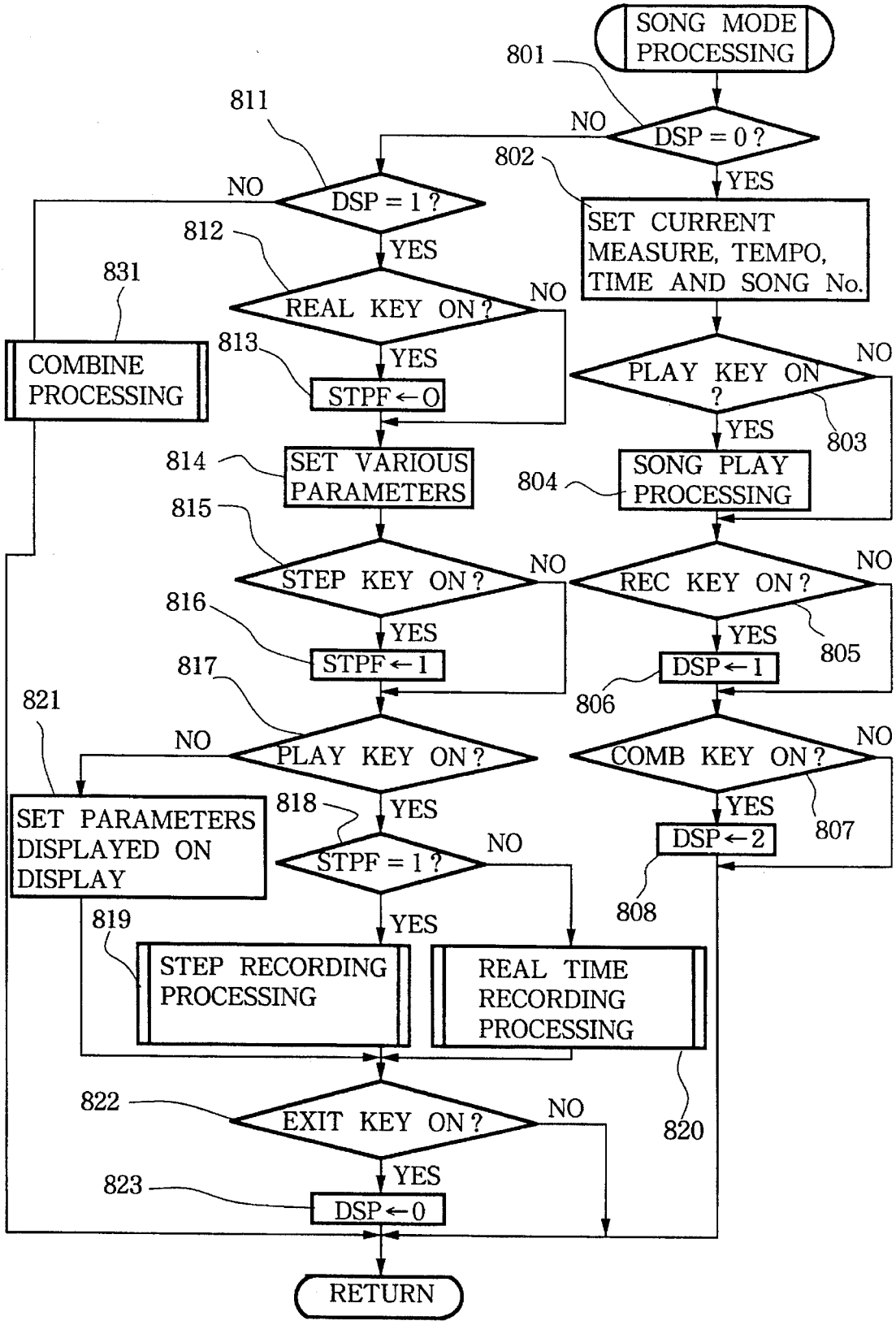

FIG. 8 shows in detail the above-mentioned song mode processing (step 705 in FIG. 7).

Referring to FIG. 8, in step 801, the display register DSP is checked. The initial value of the register DSP is "0". If the value of the register DSP is "0", the flow advances to step 802. In this case, for example, screen data shown in FIG. 5A is displayed on the display 37. In step 802, the cursor keys 63 and 65, the "+" and "–" keys 67 and 69, and the ten keys 71 to 80 are checked. IF these keys are operated, setting data of current measure data MEAS, tempo data TEMP, time data TIME, and song number data SONG are changed according to the operations. In the display screen mode shown in FIG. 5A, parameter values (numeric values) are changed in accordance with the changed setting data. In step 803, it is checked if the play (PLAY) key 57 is turned on. If YES in step 803, song play processing is executed in step 804, and thereafter, the flow advances to step 805; otherwise, the flow directly jumps from step 803 to step 805 while skipping step 804. The song play processing can be performed in the same manner as in a conventional automatic performance apparatus. For example, data in a header portion of a performance data storage track designated by the song number data SONG are read out, and setting of the tempo register TEMP and the time register TIME, and display data of the display, an output operation of tone color data to the sound source circuit 27, and the like are performed. A tempo clock is set to have a period according to the tempo register TEMP and is counted. Every time the count value coincides with duration data of performance data, the performance data is read out and is outputted to the sound source, readout duration and gate time data are set, and key-on processing according to readout note data, velocity data, and the like is executed. Every time the count value coincides with the gate time data, key-off processing of a note corresponding to the gate time data is executed. The current measure data MEAS is calculated based on the count value and the time data TIME, and is set and displayed.

In step 805, it is checked if the recording (REC) key 59 is turned on. If YES in step 805, the display register DSP is set to be "1" in step 806, and thereafter, the flow advances to step 807; otherwise, the flow directly jumps from step 80S to step 807 while skipping step 806. When the setting value of the register DSP is changed to "1", the display screen mode of the display 37 is changed to that shown in FIG. 5B or 5C in accordance with the setting state of the step Flag STPF.

In step 807, it is checked if the combine (COMB) key 62 is turned on. If YES in step 807, the display register is set to be "2" in step 808, and thereafter, the flow returns to the previous processing (step 709 in the main routine shown in FIG. 7); otherwise, the Flow directly returns from step 807 to the previous processing while skipping step 808. When the setting value of the register DSP is changed to "2", the display screen mode of the display 37 is changed to that shown in FIG. 51).

If "NO" in step 801, i.e., if it is determined that the value of the display register DSP is "1" or "2", the flow advances from step 801 to step 811 to check if the value of the display register DSP is "1". If YES in step 811, the flow advances to step 812 to check if the REAL key 53 for setting the real time input mode is turned on. If YES in step 812, the step input mode flag STPF is cleared in step 813, and various parameters according to the real time input mode are set in step 814. If the flag STPF is "0", the display screen mode on the display 37 is as shown in FIG. 5C. Various parameters such as the tempo data TEMP, and the like set in step 814 are displayed in this display screen mode.

If "NO" in step 812, i.e., if it is determined that the REAL, key 53 is not turned on, the flow skips steps 813 and 814, and directly jumps from step 812 to step 815.

In step 815, it is checked if the STPF key 55 for setting the step input mode is turned on. If YES in step 815, the step input Flag STPF is set in step 816, and thereafter, the Flow advances to step 817; otherwise, the flow directly jumps from step 815 to step 817 while skipping step 816. When the flag STPF is set in step 816, the display screen mode of the display 37 is switched to that shown in FIG. 5B.

It is checked again in step 817 if the PLAY key 57 is turned on. If YES in step 817, it is checked in step 818 if the step input mode flag STPF is set (STPF=1). If YES In step 818, step recording processing is executed in step 819, and thereafter, the flow advances to step 821; otherwise, real time recording processing is executed in step 820, and thereafter, the flow advances to step 821. If "NO" In step 817, i.e., if it is determined that the PLAY key 57 is not turned on, the flow advances from step 817 to step 821. In step 821, the cursor keys 63 and 65, the "+" and "–" keys 67 and 69, and the ten keys 71 to 80 are checked like in step 802, and the registers and the display mode of the display 37 corresponding to the parameters displayed on the display 37 according to these key operations are changed. When there are a large number of parameters exceeding a capacity of one screen of the display 37, as indicated by dotted lines and alternate long and short dashed lines in FIG. 5B, the display screen is switched according to the cursor position. Upon completion of these processing operations, the flow advances to step 821.

It is checked in step 821 if an EXIT key for canceling the recording mode is turned on. If YES in step 821, the display register DSP is set to be "0" in step 822, and thereafter, the flow returns to the previous processing (step 709 in the main routine shown in FIG. 7); otherwise, the flow directly returns to the previous processing while skipping step 822. When the setting value of the register DSP is changed to "0", the display screen mode of the display 37 is switched to that shown in FIG. 5A.

If "NO" in step 811, i.e., if it is determined that the value of the display register DSP is "2", the flow advances From step 811 to step 831 to execute combine processing, and thereafter, the flow returns to the previous processing (step 709 in the main routine shown in FIG. 7).

Figures 9, 10:
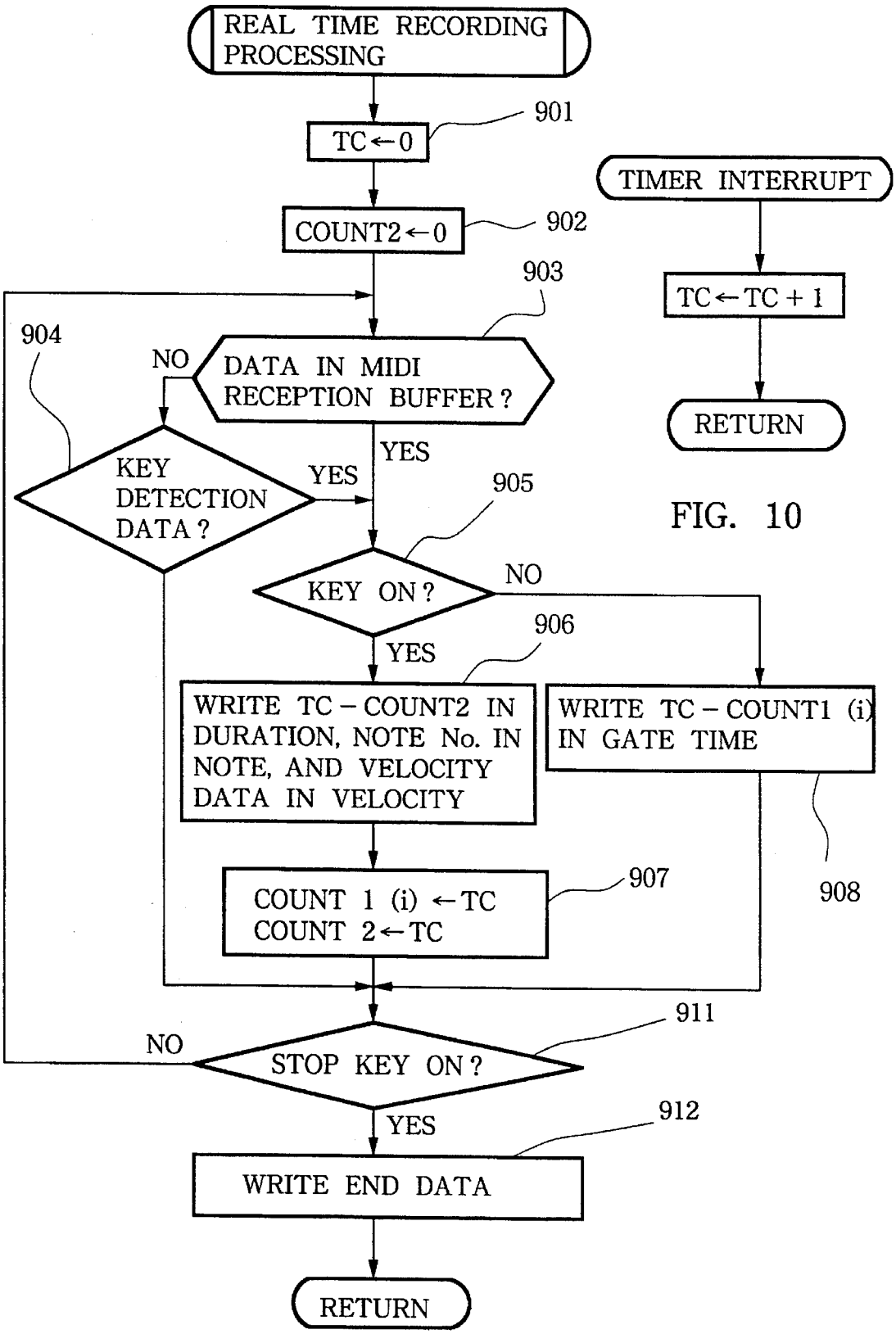

FIG. 9 shows in detail the real time recording processing In step 819 in FIG. 8.

Referring to FIG. 9, the tempo clock register TC is cleared in step 901. The tempo clock register TC is incremented at a period corresponding to 1/24 a quarter note in timer interrupt processing shown in FIG. 10 using a clock pulse outputted from the timer circuit 31 in FIG. 1 as an interrupt signal.

In step 902 in FIG. 9, the second counter COUNT2 is cleared. The counter COUNT2 is a counter for counting a time from a given key ON event to the next key ON event, i.e., duration. In step 903, it is checked if a reception buffer of the MIDI interface 19 stores data. The reception buffer stores data when it receives data From, e.g., an external MIDI keyboard. If NO in step 903, it is checked in step 904 if the key detection circuit 21 has detection data of a keyboard operation. If the reception buffer stores data, the Flow advances from step 903 to step 905, or if the key detection circuit 21 has detection data, the flow advances from step 904 to step 905.

In step 905, it is checked if data in the reception buffer or the key detection circuit 21 is data representing a key ON event. If YES in step 905, duration data, note number data, and velocity data are written in the performance data storage track of the RAM 17 in step 906. In this case, the duration data is calculated as a difference TC–COUNT2 between a current timing as a count value of the tempo clock register TC, and a previous key ON event generation timing as a data value stored in the second counter COUNT2. The note number data, and the velocity data are read out from the data in the reception buffer or the key detection circuit 21. In step 907, a count value TC of the tempo clock register TC is transferred to the first counter COUNT1 (i) for detecting a gate time, and the second counter COUNT2 for detecting a duration, thereby updating the contents of these counters. The contents of these counters are used in step 906 described above, and in step 908 to be described later. Upon completion of the processing in step 907, processing in step 911 is then executed.

If "NO" in step 905, i.e., if it is determined that the data in the MIDI reception buffer or the key detection circuit 21 is data representing a key OFF event, the flow advances from step 905 to step 908. In step 908, a difference between the count value TC of the tempo clock register and the numeric value COUNT1(i) stored in the first counter corresponding to a channel i to which a key-OFF note is assigned is written as a gate time in the performance data storage track, and thereafter, the flow advances to step 911.

It is checked in step 911 if the stop (STOP) key 61 is turned on. If YES in step 911, end data is written in the performance data storage track in step 912, and the real time recording processing is ended. Thereafter, the flow returns to the previous processing (step 822 in FIG. 8).

On the other hand, if "NO" in step 911, i.e., if it is determined that the STOP key 61 is not turned on, the flow returns from step 911 to step 903, and the processing operations in steps 903 to 911 are repeated.

Figure 11:
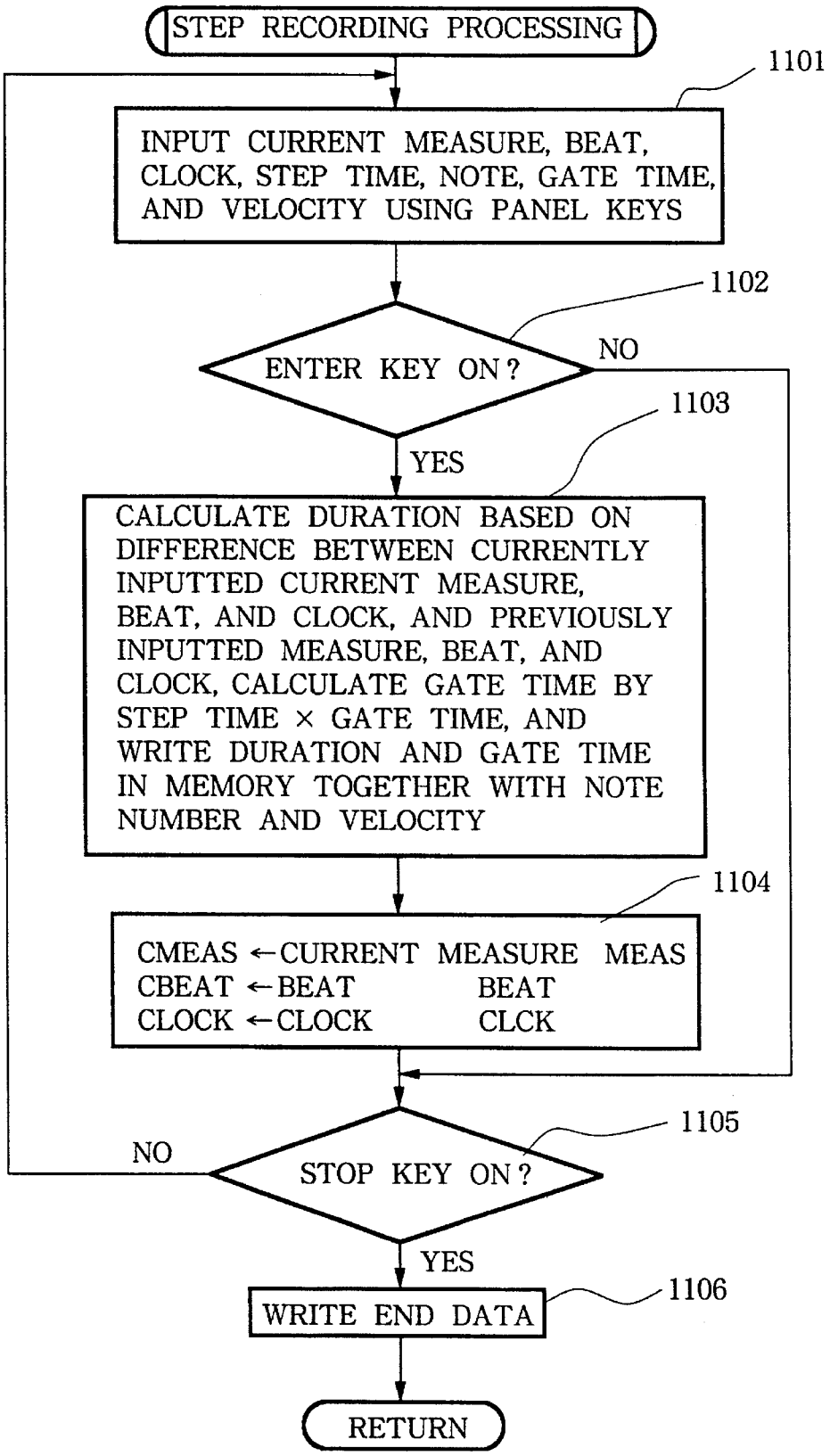

FIG. 11 shows in detail the step recording processing in step 820 in FIG. 8.

Referring to FIG. 11, in step 1101, current measure data MEAS (which measure is being currently subjected to formation of performance data), beat data BEAT, clock data CLCK, step time data STEP, note data NOTE, gate time data GATE, velocity data VEL, and the like which are inputted using the panel keys 63 to 80 such as cursor keys, ten keys, and the like are read. In step 1102, it is checked if an enter (ENTER) key 84 is turned on. If YES in step 1102, duration data, gate time data, note number data, and velocity data are written in the performance data storage track TRCK of the RAM 17. In this case, the duration data is obtained based differences between the currently inputted current measure data MEAS, beat data BEAT, and clock data CLCK, and the previously inputted measure data CMEAS, beat data CBEAT, and clock CLOCK; and gate time data is obtained based on a product of the currently inputted step time data and gate time data. As the note number data and the velocity data, currently inputted note number data NOTE and velocity data VEL are directly used. In step 1104, the currently inputted current measure data MEAS, beat data BEAT, and clock data CLCK are stored in the corresponding registers CMEAS, CBEAT, and CLOCK. These data CMEAS, CBEAT, and CLOCK are used as previously inputted data upon next execution of the processing in step 1103.

If "NO" in step 1102, i.e., if it is determined that the ENTER key 84 is :not turned on, the flow directly jumps from step 1102 to step 1105 while skipping processing in steps 1103 and 1104.

It is checked in step 1105 if the STOP key 61 is turned on. If YES in step 1105, end data is written in the performance data storage track in step 1106, and thereafter, the step recording processing is ended. Thereafter, the flow returns to the previous processing (step 822 in FIG. 8).

If "NO" in step 1105, i.e., if it is determined that the STOP key 61 is not turned on, the flow returns from step 1105 to step 1101, and the processing operations in steps 1101 to 1105 described above are repeated.

Figure 12:
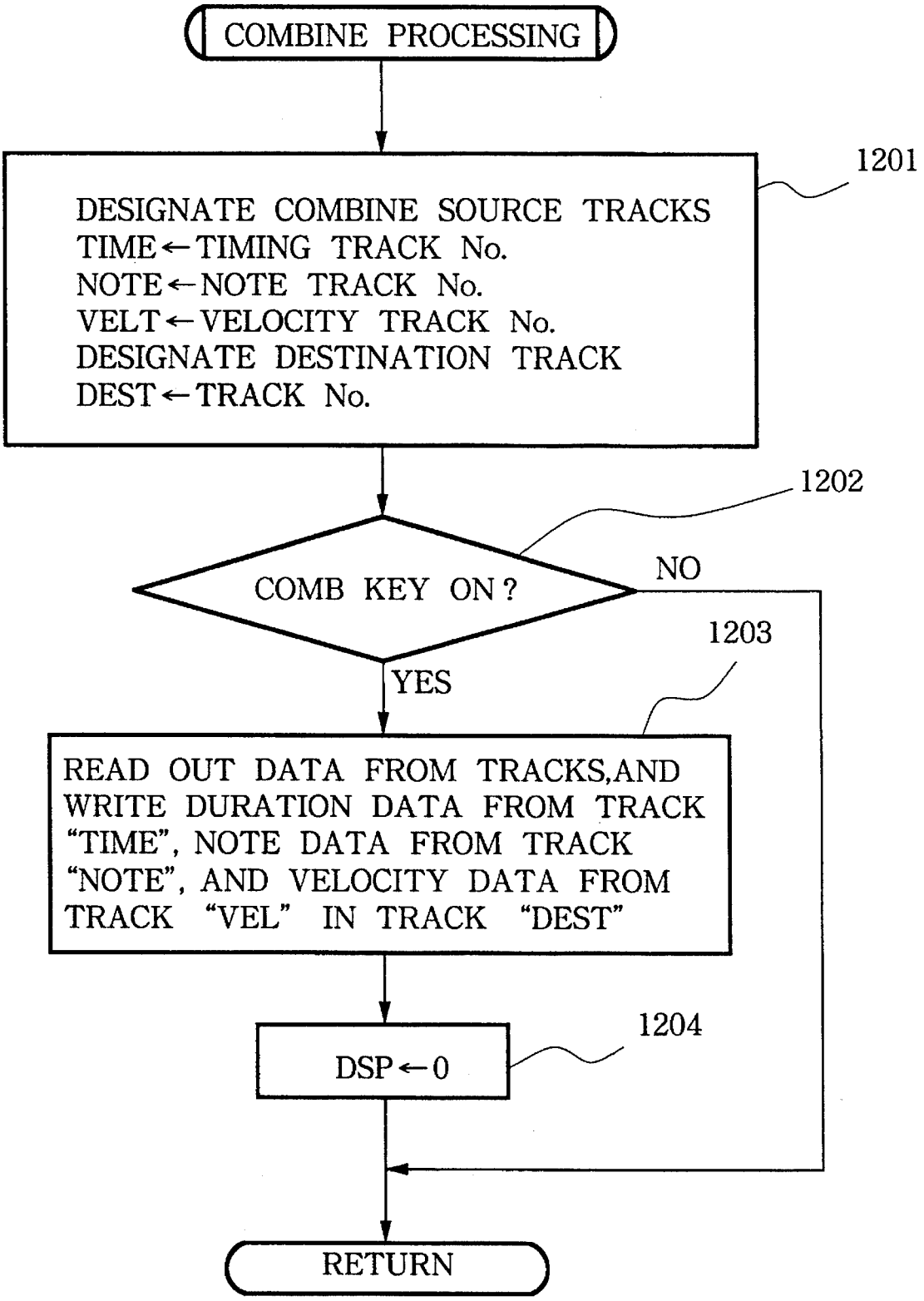

FIG. 12 shows in detail the combine processing in step 831 in FIG. 8.

Referring to FIG. 12, in step 1201, tracks ( source tracks) as combine sources designated using the panel keys 63 to 80 such as the cursor keys, ten keys, and the like while observing the display 37, i.e., timing data, note number data, and velocity data reading track numbers are stored in the corresponding registers TIME, NOTE, and VELT. In step 1202, it is checked if the combine (COMB) key 62 is turned on. If YES in step 1202, data are read out from the source tracks TIME, NOTE, and VELT, and duration data in the source track TIME, note number data in the source track NOTE, and velocity data in the source track VELT are written in a track (destination track) DEST as a write destination in step 1203. In step 1203, there is used a concrete synthesizing (or combining) method wherein the first duration data of timing data read out from the source track TIME is written in the destination data track, the first duration data of note data read out from the source track NOTE is written in the destination data track, then the first duration data of velocity data read from the source track VELOCITY is written in the destination data track, and the second duration data of timing data read out from the source track TIME is written in the destination data track. In the same manner as above, the timing data, pitch data and velocity data are sequentially written in the destination track. In step 1203, as for a chord (a plurality of note data having the same key ON timing), a chord is considered as one event with respect to the source track TIME for fetching time data, and the shortest gate time is fetched as data for new performance data. In the source track NOTE for fetching note data, all the note data having the same key ON timing in a chord are fetched as data having the same timing. Furthermore, in the source track VELT for fetching velocity data, highest velocity data of velocity data having the same key ON timing in a chord is fetched as data for forming performance data.

Furthermore, in step 1204, the display register DSP is set to "0", and the flow returns to the previous processing (step 709 in FIG. 7).

Figure 13:
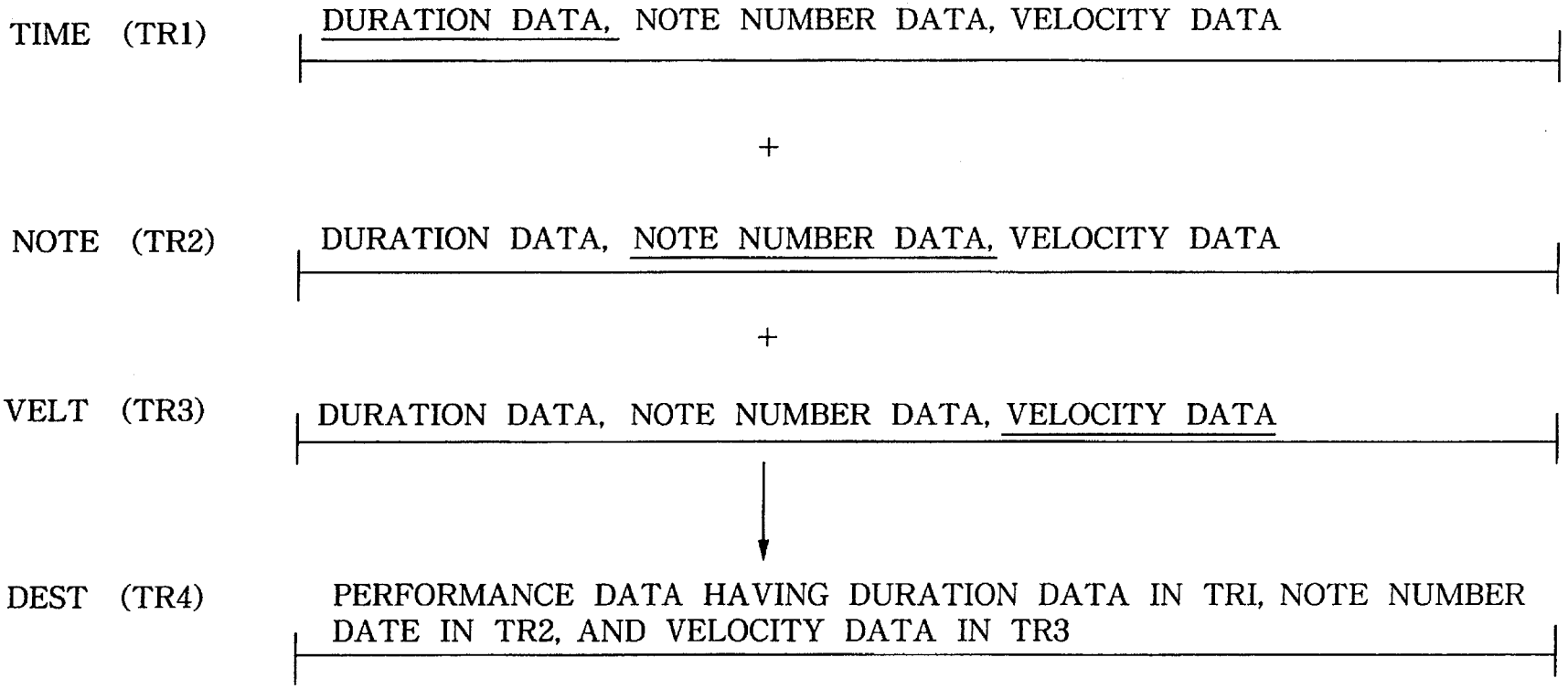
FIG. 13 is a view showing the principle of synthesizing performance data in the apparatus shown in FIG. 1.

FIG. 13 shows the principle of performance data formation processing (combine processing)in the apparatus shown in FIG. 1.

More specifically, performance data storage tracks TR1 to TR3 (source tracks) respectively store duration data, note number data, and velocity data. These data are respectively read out from the corresponding tracks, and are simultaneously written in one track, thereby forming new data. In this case, a track for receiving new data (destination track DEST) may be another track TR4, or may be an arbitrary one of the three tracks from TR1 to TR3. Duration data and velocity data may use the same track, and only note number data may use another track.

In this manner, for example, pitch data can be read out from the track TR1, timing data can be read out from the track TR2, velocity data can be read out from the track TR3, and these readout data are synthesized in one track to form automatic performance data. Thus, the track TR1 can carefully record only pitch data regardless of recording precision of timing data, and the like, the track TR2 can carefully record only timing data regardless of recording precision of pitch data, and the like, and the track TR3 can carefully record only velocity data. Therefore, a user who cannot play the keyboard instrument can easily form automatic performance data without requiring a long time.

The present invention is not limited to the above embodiment, and various changes and modifications may be made within the spirit and scope of the invention.

For example, in the above embodiment, software processing has been exemplified. However, the above-mentioned processing may be realized using a hardware arrangement.

In the above embodiment, a performance data storage track is commonly used as a source track. For example, special-purpose source tracks for storing one or a plurality of data may be arranged.

In the above embodiment, duration data, note number data, and velocity data are stored in a single track. However, other data may be stored in a single track. The data format is not limited to that in the above embodiment.

The present invention can be applied to a rhythm instrument, and the like.

What is claimed is:

1. An automatic performance apparatus for synthesizing musical tones in accordance with sequential performance data, said sequential performance data including plural types of sequential element data including at least pitch data and timing data, said apparatus comprising:

at least one performance data storage track for storing said sequential performance data for controlling musical tones to be sequentially generated according to progress of music;

a plurality of element data storage tracks for storing said sequential element data arranged in an order according to progress of said music, said sequential element data for each track including more than one type of element data from among several plural types of said element data constituting said sequential performance data;

designation means for designating at least one of said element data storage tracks according to at least one of said plural types of said element data to be read from said at least one designated element data storage track independent of the other types of element data, wherein said designated element data type is unique for each said at least one designated element data storage track;

control means for sequentially reading and synthesizing said element data from each said designated element data storage track according to said designation means to form synthesized performance data, and writing the synthesized data in said performance data storage track as said sequential performance data; and performance means for generating said musical tones in accordance with said sequential performance data.

2. An apparatus according to claim 1, wherein there are plural performance data storage tracks, said element data storage tracks are realized by commonly using some or all of said performance data storage tracks, said designation means designates at least performance data storage tracks which store sequential element data comprising pitch data and timing data used for synthesis of said synthesized performance data, and said control means writes the synthesized performance data to one of the performance data storage tracks which is designated by said designation means.

3. An apparatus according to claim 1, further comprising performance data inputting means for inputting said sequential performance data, means for detecting the performance data inputted by the inputting means and second control means for sequentially writing the detected sequential performance data to at least one element data storage track.

4. An apparatus according to claim 3, wherein said second control means further comprises means for detecting said sequential element data in said inputted sequential performance data, and sequentially writes the detected results sequential element data to said element data storage tracks.

5. An apparatus according to claim 3, wherein said second control means further comprises means for detecting said pitch data and said timing data respectively inputted as the element data, and sequentially writes the detected pitch data and timing data to said element data storage tracks.

6. A performance data recording apparatus comprising:

a performance data storage track for storing sequential performance data for controlling musical tones to be sequentially generated according to progress of a musical piece;

a first element data storage track for sequentially storing element data including at least pitch data and timing data;

a second element data storage track for sequentially storing element data including at least pitch data and timing data;

designation means for designating said first and second element data storage tracks according to a designated element data type including at least one of pitch data and timing data independent of the other types of element data, wherein said designated element data type is unique for each of said first and second element data storage tracks;

control means for sequentially reading the element data according to said designation means from the first element data storage track and said second element data storage track;

means for synthesizing said element data to form synthesized performance data; and means for writing said synthesized performance data to said performance data storage track to form said sequential performance data.

7. An apparatus according to claim 6, further comprising a third element data storage track for sequentially storing at least velocity data, wherein said designation means further includes designating said first, second and third element data storage tracks according to a designated element data type including at least one of pitch data, timing data and velocity data independent of the other types of element data, wherein said designated element data type is unique for each of said first, second and third element data storage tracks; and wherein said control means sequentially reads out the pitch data, timing data and velocity data respectively from the first, second and third element data storage tracks according to said designation means, and said means for synthesizing said pitch data and said timing data further comprises means for synthesizing said velocity data to form said synthesized performance data.

8. An apparatus according to claim 6, wherein there are a plurality of performance data storage tracks respectively for storing performance data comprising at least timing data and pitch data, and wherein said apparatus further comprises designation means for designating one of said performance data storage tracks from which the pitch data is sequentially read as the first element data storage track, and another of said performance data storage tracks from which the timing data is read as the second element data storage track.

9. An automatic performance apparatus for generating new performance data, comprising:

means for inputting first and second performance data for controlling a sequence of musical tones to be generated according to a corresponding musical piece, said first performance data including at least pitch data for designating a pitch of each tone of said sequence of musical tones and timing data for designating a timing of each tone of said sequence of musical tones, and said second performance data including at least pitch data for designating a pitch of each tone of said sequence of musical tones and timing data for designating a timing of each tone of said sequence of musical tones;

first means for storing said first performance data;

second means for storing said second performance data;

third means for storing new performance data;

first means for writing said first and second performance data received from said means for inputting to said first and second means for storing, respectively;

means for synthesizing said first and second performance data to form said new performance data, said means for synthesizing including means for reading said first and second performance data from said first and second means for storing, respectively, and means for combining said pitch data from said first performance data with said timing data from said second performance data; and second means for writing said new performance data to said third means for storing.

10. The apparatus according to claim 9, wherein said timing data includes a tone generation start time and a tone generation sustain time.

11. The apparatus according to claim 9, wherein said means for inputting further comprises an operation element for forming pitch of said sequence of musical tones, said pitch data and said timing data being formed by said operation element.

12. The apparatus according to claim 11, wherein said means for inputting further comprises a keyboard.

13. The apparatus according to claim 9, wherein said means for inputting further comprises a first operation element for designating pitch of said sequence of musical tones, and a second operation element for designating timing of said sequence of musical tones, said pitch data being formed by said first operation element and said timing data being formed by said second operation element.

* * * * *